US006561709B2

(12) United States Patent
McVeigh et al.

(10) Patent No.: US 6,561,709 B2
(45) Date of Patent: May 13, 2003

(54) SHEET SET STACKING SYSTEM WITH REDUCED STUBBING

(75) Inventors: Daniel J. McVeigh, Webster, NY (US); Bryan C. Winkelman, Webster, NY (US)

(73) Assignee: Xerox Corporation, Stamford, CT (US)

( * ) Notice: Subject to any disclaimer, the term of this patent is extended or adjusted under 35 U.S.C. 154(b) by 52 days.

(21) Appl. No.: 09/895,109

(22) Filed: Jul. 2, 2001

(65) Prior Publication Data

US 2003/0001326 A1 Jan. 2, 2003

(51) Int. Cl.[7] ..... B41J 11/58

(52) U.S. Cl. ..... 400/625; 400/624; 270/58.11; 270/58.13

(58) Field of Search ..... 400/624, 625, 400/626; 271/178, 180, 217, 220, 221; 414/791, 792.7, 793.9, 794; 270/58.07, 58.09, 58.11, 58.12, 58.13, 59.19

(56) References Cited

U.S. PATENT DOCUMENTS

| | | | | | |
|---|---|---|---|---|---|
| 5,098,074 | A | * | 3/1992 | Mandel et al. | 270/58.13 |
| 5,409,201 | A | | 4/1995 | Kramer | 270/53 |
| 5,409,202 | A | | 4/1995 | Naramore et al. | 270/53 |
| 5,642,876 | A | | 7/1997 | Ferrara et al. | 270/58.01 |
| 5,685,532 | A | | 11/1997 | Amarakoon | 270/58.07 |
| 5,803,705 | A | | 9/1998 | Keyes | 414/793.9 |
| 6,244,583 | B1 | | 6/2001 | Ohmichi et al. | 270/58.09 |
| 6,260,837 | B1 | * | 7/2001 | Nanba et al. | 270/58.08 |
| 6,328,299 | B1 | * | 12/2001 | Coombs | 270/58.08 |

* cited by examiner

*Primary Examiner*—Andrew H. Hirshfeld
*Assistant Examiner*—Minh Chau

(57) ABSTRACT

A set fastening, ejecting, and stacking system for stacking sets of printed sheets with staples or other set fasteners that are being ejected by a set ejector with a horizontal movement component to slide the stapled set out over the stack. An automatic dynamic ramp system is provided by a foldable member which is folded in a vertical direction by the horizontal movement of the set ejector to temporarily lift up the stapled area of the set out of contact with the stack while that set is being ejected to prevent snagging.

11 Claims, 7 Drawing Sheets

SHEET SET STACKING SYSTEM WITH REDUCED STUBBING

Disclosed in the embodiment herein is an improved but very simple and low cost system for the stacking ejection of sets of sheets onto a stack of sheets, with reduced tendencies for stubbing or snagging in doing so, by automatic lifting up of the stapled or other problem-portion of the set being ejected above the stack during the ejection of that set onto the stack. As further disclosed in this embodiment, this can desirably be done without requiring a separate drive system by utilizing and converting the existing set ejection system motion to provide a dual mode, dual direction, set ejection system.

By way of background, although the disclosed embodiment is shown in the compact set stacking output system of a "disk stacker", it is applicable to various other sheet stacking systems. It is especially of interest for overcoming the "stubbing" problems of stapled sets being substantially horizontally ejected to be stacked on top of other stapled sets. It is a recognized problem that the staples or other projections can interfere with (cause "stubbing") as that set is being pushed out over the previously stacked set.

This "stubbing" problem is of particular concern in compact combined set compiling and stacking systems, in which the sets are stacked on a stack elevator which maintains the top of the stack at about the same level as the bottom of the set being compiled and stapled. That is, roughly level with, rather than much lower than, the compiler surface. That is done so as to partially support the overhanging (projecting) portion of the set being stapled. That allows the set compiling area to be smaller than the sheet dimensions in the process direction. Such known compact combined compiling and stacking systems desirably partially combine the horizontal space that would be required by a separate compiler and separate stacker.

Current methods to combat this problem include the use of a separate solenoid actuated and spring loaded "set separator" arm mechanism inserted out over part of the previously ejected and stacked set, then retracted for the next set, e.g., Minolta Co., Ltd., U.S. Pat. No. 6,244,583 B1, issued Jun. 12, 2001. That system has a relatively high cost, several moving parts, space requirements, is exposed to damage, and requires additional software to control it. Furthermore, as multiple stapled sets accumulate on top of one another in the output stack the overlying staples thereof tend to cause those staple areas to stick up or rise higher that the rest of the stack.

Other efforts to solve this stubbing problem in finisher compiled, stapled and stacked sets systems have included designs for different stacking tray angles, and/or stacking tray corner cut-outs (stack unsupported areas), especially for finished sets which are only corner-stapled, as compared to plural edge stapled. While none of those designs are excluded from, or incompatible with, use with the present system, the disclosed system is believed to be far more effective for reducing the stubbing problem.

Disclosed in the embodiment herein is a simple and low cost dual mode system and mechanism, capable of utilizing the existing horizontal movement of a set ejection system, so as not to require any additional drive system, yet automatically lifting up the stubbing problem portion of the compiled set vertically relative to the prior stacked sets during the otherwise horizontal or downstream ejecting movement of the (stapled or unstapled) set. This simple yet effective system can then also automatically retract downwardly with the rearward retraction of the set ejector so as not to interfere with further compiling or stapling operations, such as the rotation and sheet stripping of a disk stacker compiling operation.

Yet, as also shown in the specific illustrated example, a relatively sophisticated stubbing prevention function can be accomplished using a simple foldable and un-foldable (hinged) plastic or metal member which forms an automatically raised and lowered ramp or guide for the sheet or set of sheets being ejected out onto the stack of sheets on the stacking surface.

That is, the disclosed embodiment shows that a dynamic ramp system to greatly reduce snubbing tendencies can be accomplished with a very simple, even one piece, device that utilizes the existing motion of the set ejecting mechanism of the finisher to perform its functions and timing. Reduced cost and improved reliability over prior systems are significant advantages.

Some examples of Xerox Corporation patents on disk stackers (noted above), and also providing some examples of compact (shared) set compiling, ejection and stacking systems (as described above), with or without set stapling, include Xerox Corp. U.S. Pat. Nos. 5,409,201; 5,409,202; 5,685,532; 5,642,876; 5,803,705; 5,692,740; 5,803,705, or 5,842,695. A different (non-disk) type of compact compiler-stapler-stacker is shown, for example, in Xerox Corp. U.S. Pat. No. 5,884,910.

A specific disclosed feature of the specific embodiment disclosed herein is to provide in a set fastening, ejecting, and stacking system for stacking in a stack of multiple printed sheets, at least some of which are sets of plural said printed sheets having one or more set fasteners in a fastening area of said printed sheets, wherein a said set of plural printed sheets with an area of one or more set is fasteners is ejected by a set ejector with a horizontal movement component to slide out over said stack of multiple printed sheets, the improvement comprising an automatic dynamic ramp system for temporarily lifting up with a vertical movement component said fastening area of said set with said set fasteners out of contact with said stack of multiple printed sheets while said set is being ejected by said set ejector with said horizontal movement component to slide out over said stack of multiple printed sheets to prevent snagging of said set fasteners with said stack of multiple printed sheets.

Further specific features disclosed in the embodiment herein, individually or in combination, include those wherein said automatic dynamic ramp system for temporarily lifting up said area of said set with said set fasteners is driven by engagement with said set ejector; and/or wherein said automatic dynamic ramp system for temporarily lifting up said area of said set with said set fasteners comprises a foldable member that is at least partially folded up vertically by said horizontal movement component of said set ejector; and/or wherein said automatic dynamic ramp system for temporarily lifting up said area of said set with said set fasteners comprises a hinged plate member that is at least partially folded up vertically about said hinge by engagement with said set ejector.

Unless otherwise defined in a claim, the terms "reproduction apparatus" or "printer" as used herein broadly encompasses various printers, copiers or multifunction machines or systems, xerographic or otherwise. Likewise, the term "sheet," or "print media" herein refers to a usually flimsy physical sheet of paper, plastic, or other suitable physical substrate for printed images, whether precut or initially web fed. A "copy sheet" may be abbreviated as a "copy" or called a "hardcopy." A "print job" is normally a set of related sheets, usually, but not necessarily one or more collated copy sets copied from a set of original document sheets or electronic document page images, from a particular user, or otherwise related. A "set" as used herein refers to whatever plurality or multiplicity of sheets have been selected to be compiled and are being ejected together for stacking. The terms "finisher" or "finishing" may broadly relate to various post-printing operations on printed sheets, which can include any of, or a combination of, set compiling, stapling, gluing, binding, hole punching, applying covers or inserts, trimming, output stacking, etc.

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein. For example, set compiling per se.

Various of the above-mentioned and further features and advantages will be apparent to those skilled in the art from the specific apparatus and its operation or methods described in the example below, and the claims. Thus, the present invention will be better understood from this description of these specific embodiment, including the drawing figures (which are approximately to scale) wherein:

Figure 1:
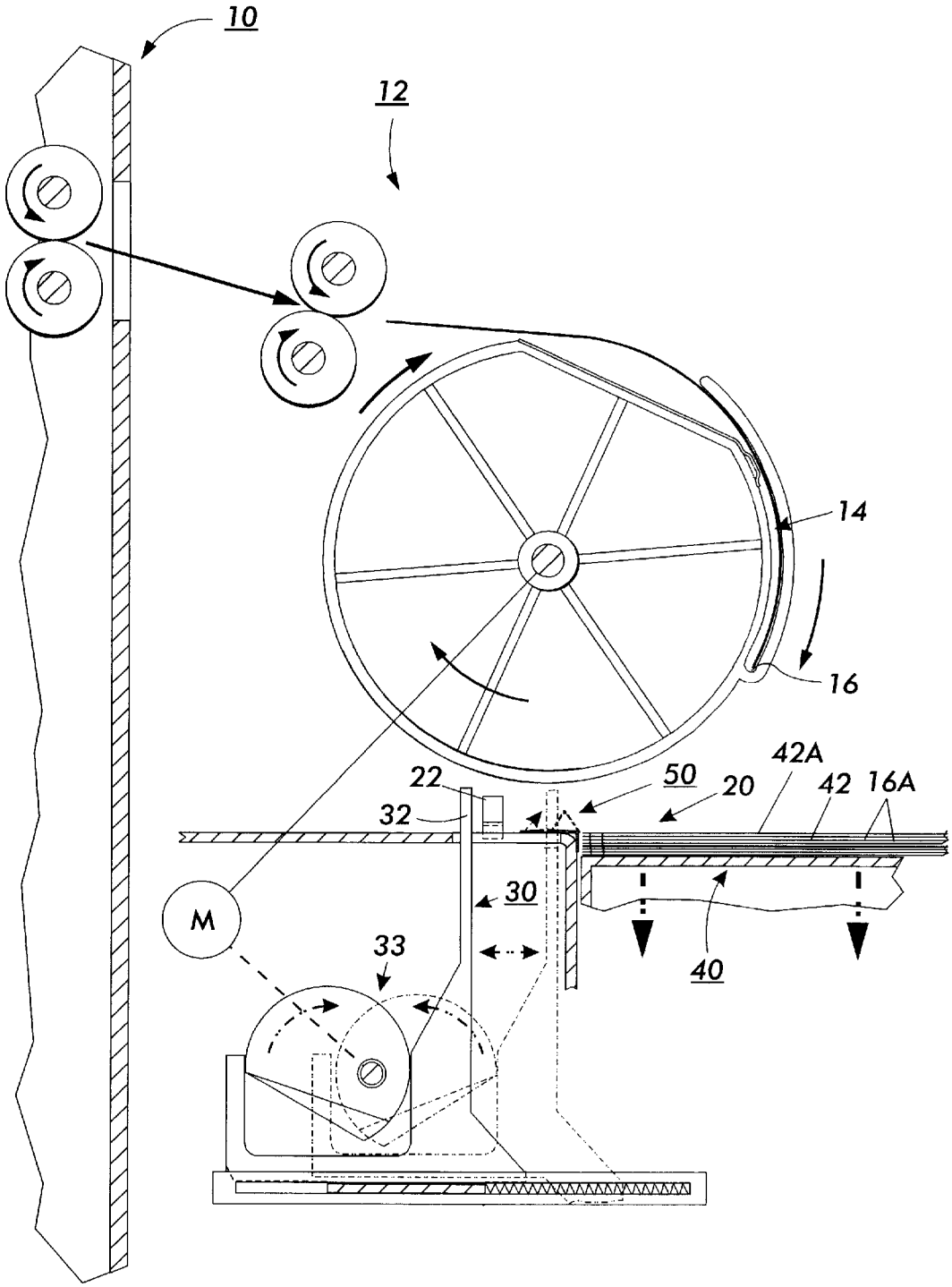
FIG. 1 shows one example of a compact disk stacker compiler, stapler, and finished sets output stacker, incorporating one example of the subject automatic dynamic ramp system for reduced stubbing.

Describing now in further detail the exemplary embodiment with reference to the above Figs., there is schematically shown in FIG. 1, merely by way of one simplified example, the output area of a printer or other conventional reproduction machine 10 with an operatively connecting conventional disk stacker-compiler-stapler finisher 12 as described in the above-cited or other patents. However, as noted above, the present system is not limited to use with such disk inverter-stackers 12. In this example, the printer 10 is conventionally sequentially feeding printed sheets 16 into the disk slots 14 of the disk stacker 12, which then is rotated by motor M to invert the sheet 16 and place the leading edge area of the sheet 16 into the compiler or compiling area 20. The rest of that sheet 16 then falls down on the top 42A of the stack 42 of sheets 16 (of previously compiled and ejected sets 16A) stacked on a stacking elevator system 40. That is because this is an example of a compact system (as described above) in which the compiling 20 and stacking 42A areas are shared or partially combined, and maintained at substantially the same level for that purpose. As described above and in the cited patents, this may be provided by a stacking elevator system 40 automatically moving down (as shown by its movement arrows) as the stack 42 accumulates, so as to maintain the top of the stack 42A at or slightly below the level of the compiler area 20.

Each incoming sheet 16 lead edge may be stopped and stripped off the disk stacker 12, to stack in the set compiling area 20, by the extended fingers or ejection surface 32 of the set ejector system 30, or by other sheet stripper fingers. Schematically shown here in the compiling area 20 is a stapler 22 for stapling 23 the compiled set 16A of sheets 16 before it is ejected by the set ejector system 30. Also shown in the compiling area 20 here is an example of the subject automatic dynamic ramp system 50 for reduced stubbing, as will be further described.

Figure 2:
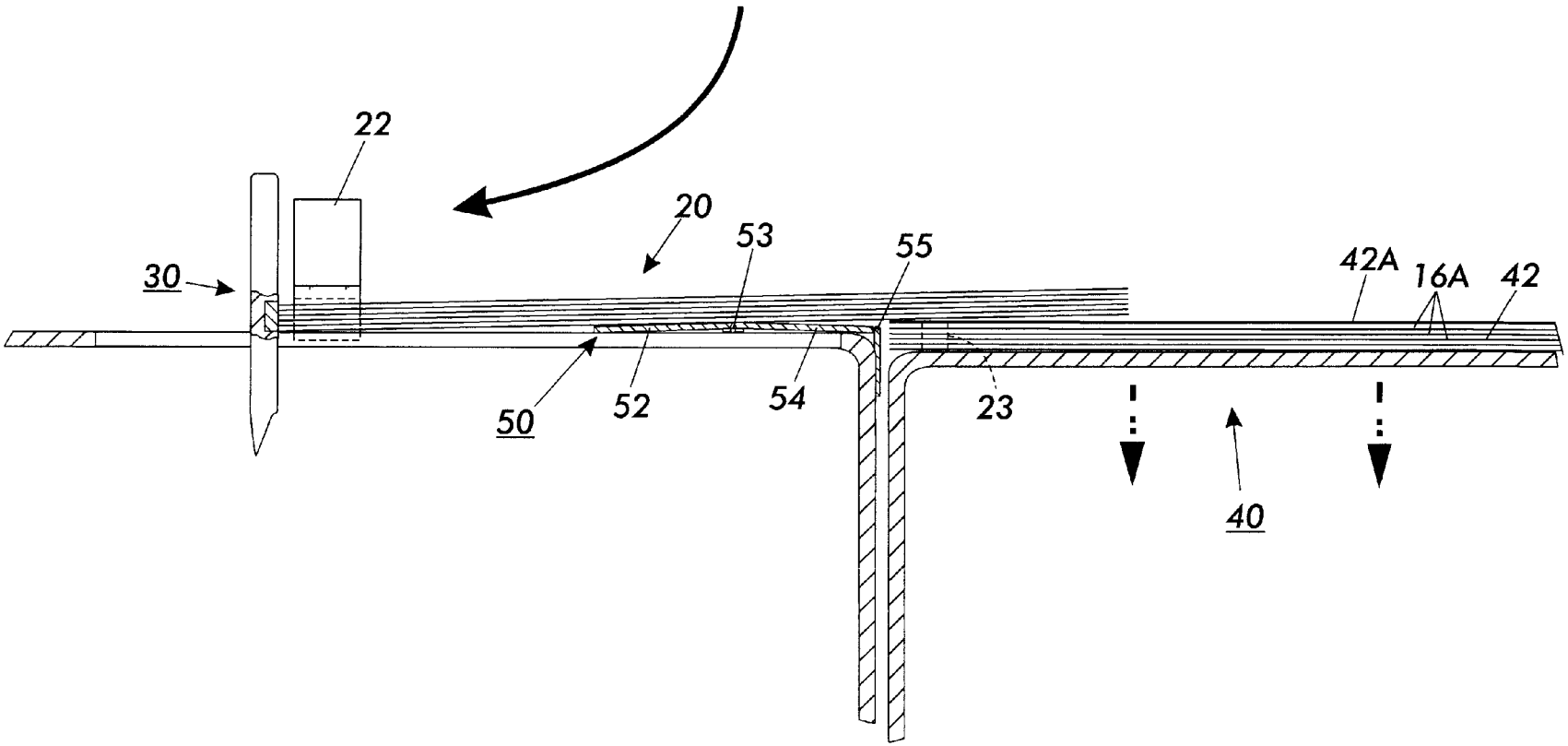
FIG. 2 shows, in an enlarged partial view of FIG. 1, the subject automatic dynamic ramp system in its initial or set compiling position.
Figure 3:
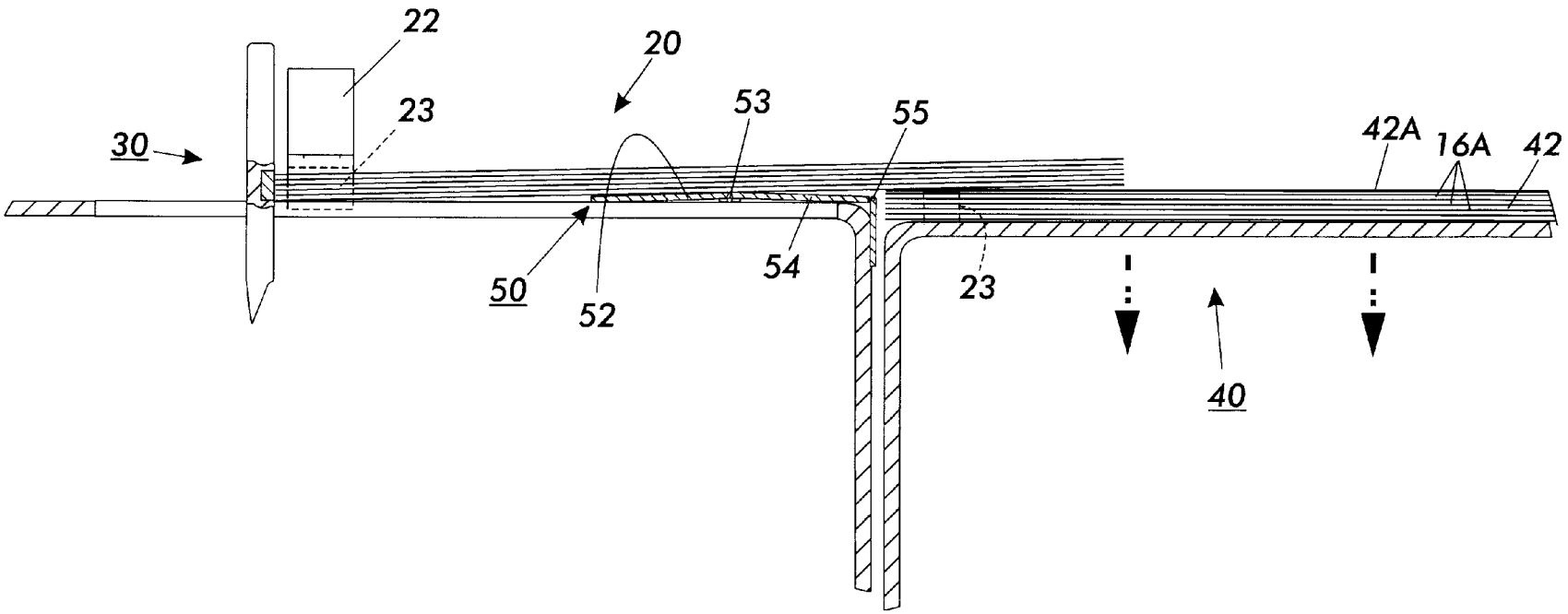
FIG. 3 is the same as FIG. 2 but showing a next step of stapling the compiled set of printed sheets.

Turning now to FIGS. 2–7, these all show the same enlarged example of an automatic dynamic ramp system 50 for reducing stubbing, showing different, sequential, operating positions thereof. The compiling area 20 has been enlarged for illustrative purposes. FIG. 2 shows a completed (fully compiled) set 16A before its stapling and ejection onto previous completed sets 16A on the output stacking tray, which in this example is the elevator tray system 40. FIG. 3 shows that during the stapling of that compiled set 16A that there is no movement of the set ejector system 30 or its operatively associated dynamic ramp system 50.

Figure 4:
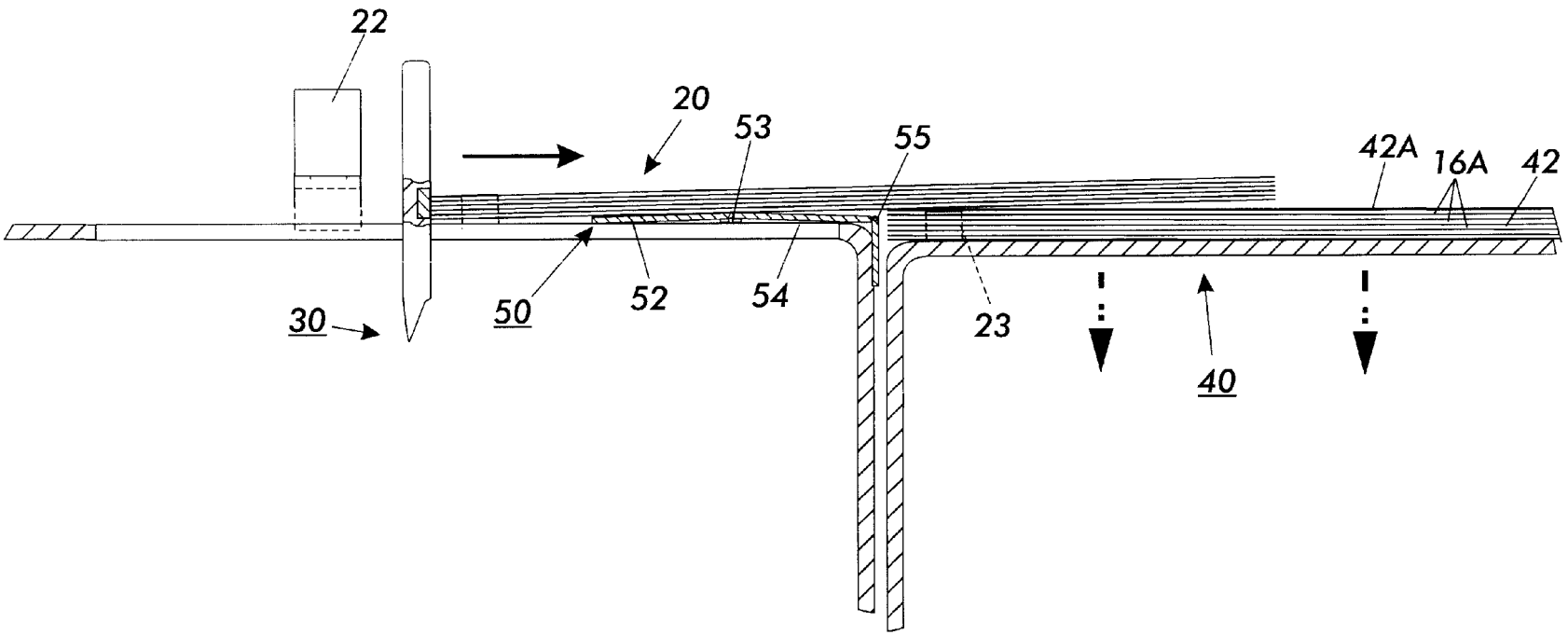
FIG. 4 is the same as FIGS. 2 and 3, but showing a next step of starting to eject the stapled compiled set out for stacking onto the preceding stacked sets with the set ejector.

FIG. 4 is showing the set ejector system 30 starting to eject the finished (stapled) set 16A from the compiler area 20 out onto (sliding over) the top 42A of output stack 42. The projecting set ejector arm 32 is now being moved towards the elevator stacking system 40 by a conventional or suitable movement system such as 33 in FIG. 1, or other reciprocal movement systems as illustrated in cited patents. The downstream face of the projecting set ejector arm 32 is thereby pushing on that end of the set 16A. At this point it may be seen that the staples 23 in that set 16A are still in the compiler area 20, so there is no potential for snubbing at this point.

Figure 5:
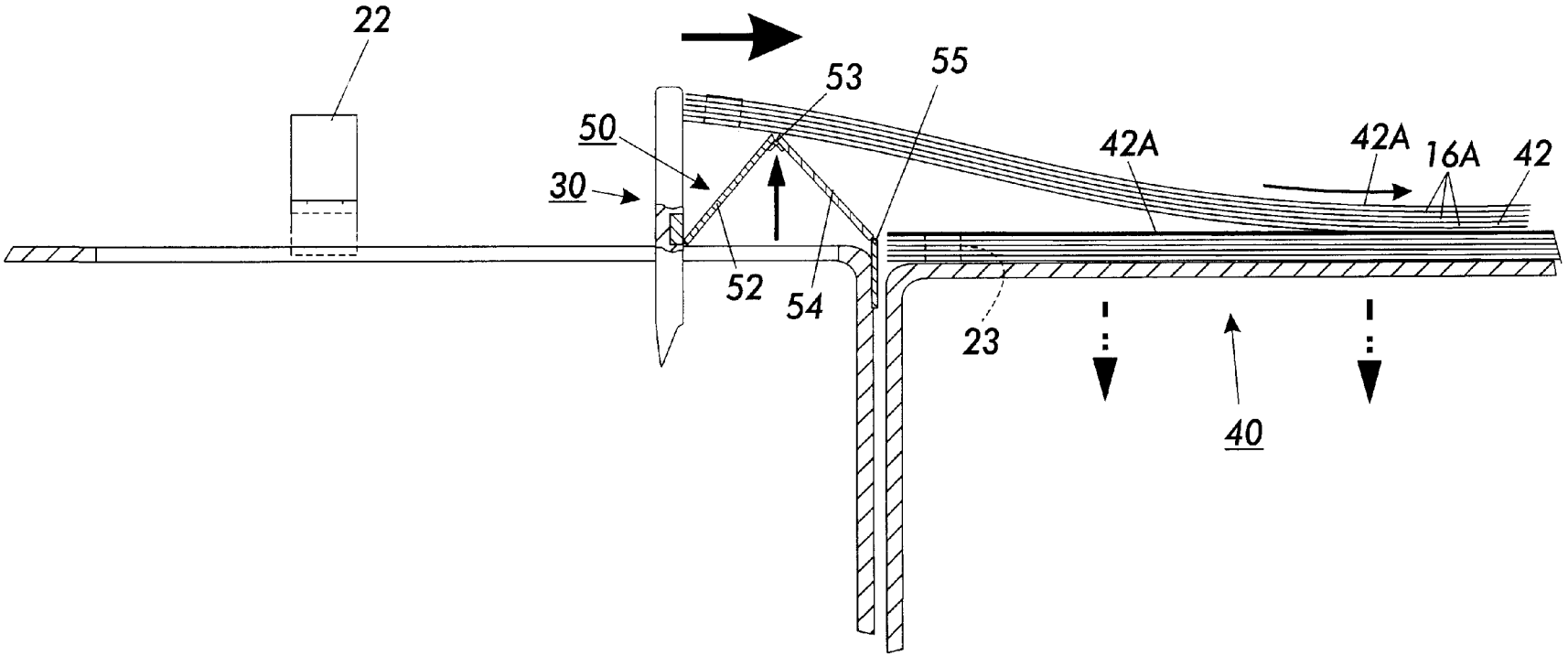
FIG. 5 is the same as FIGS. 2–4, but showing having partially ejected the stapled compiled set out for stacking onto the preceding stacked sets with the assistance of the automatic lifting of the dynamic ramp system being driven by the set ejector.

In the further set ejection movement of set ejector arm 32 shown in FIG. 5 that set ejection system has now engaged and started to operate the dynamic ramp system 50. That dynamic ramp system 50 is now automatically lifting the stapled upstream end of the stapled set 16A up and over the previously ejected and stacked sets on the output stacking system 40, to prevent stubbing. That is, as shown in FIG. 5, only the downstream end of the set 16A being ejected is now contacting and sliding over the top surface 42A of the stack 42. The staples 23 in the set 16A being ejected are being held up away and above any staples in the previously ejected set by the dynamic ramp system 50.

Figure 6:
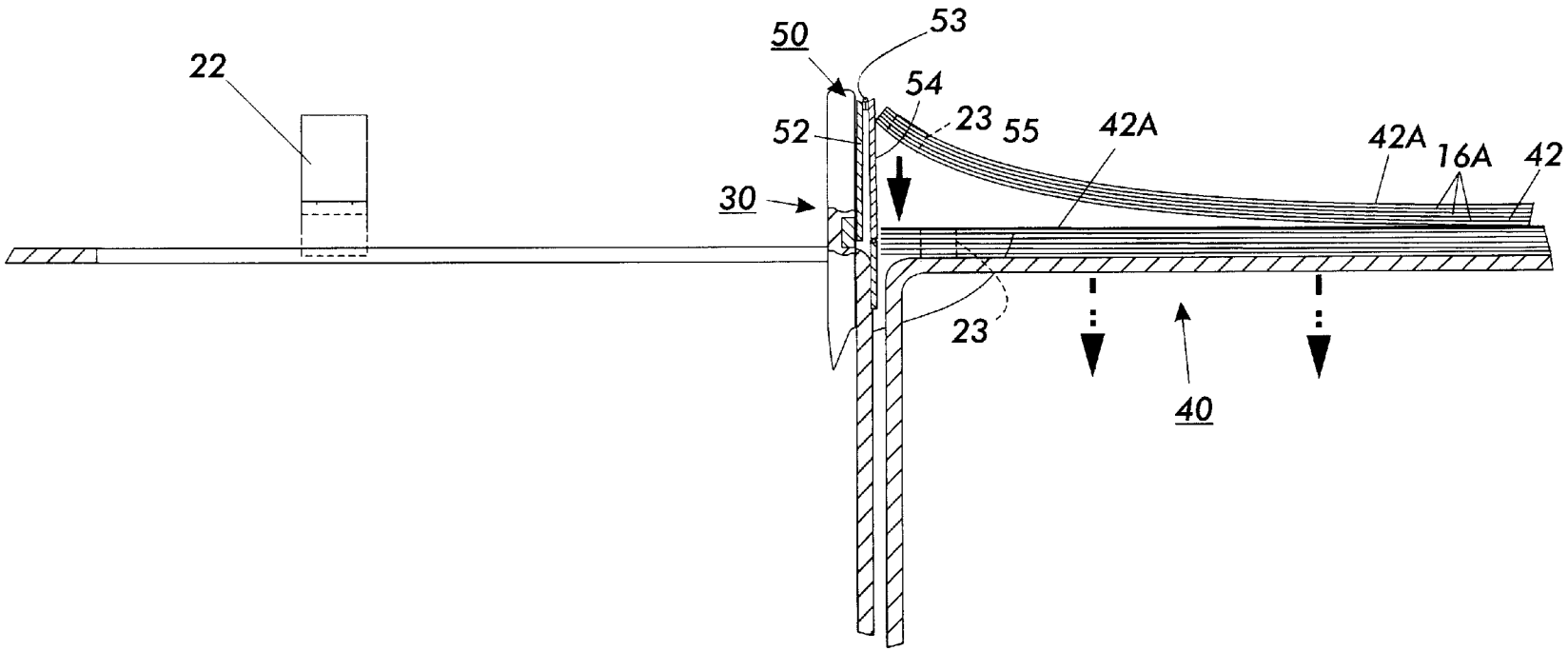
FIG. 6 is the same as FIGS. 2–5, but showing the completion of ejecting the stapled compiled set out for stacking by the maximum set ejector movement.

FIG. 6 is showing the completion of the ejecting of the set 15A and shows that its stapled area being dropped in place on top of the sets in the output tray, not slid into place.

Turning now to the exemplary dynamic ramp system 50, it may be seen that it comprises here two planar plate members or elements 52 and 54 centrally connected by a hinge portion 53. That can be a normal hinge as shown, or a thin hinge area in a single plastic plate providing a conventional fatigue resistant plastic. It may be slightly raised to provide a small angularity between the members 52 and 54 even in the compiling position of FIG. 2, and stapling position of FIG. 3, so as to assist in the subsequent folding up of the members 52 and 54 on the hinge 53 line, as shown in FIG. 5, by the downstream movement of the set ejector 30 finger 32 against the upstream end of the member 52 while the downstream end of the member 54 is being held in position by the second hinge 55 or some other mounting system. As shown in FIG. 6, when the set ejector finger 32 reaches the stacking system 40 and has pushed that set 16A out superposed over the set 42 for the completion of stacking the dynamic ramp system 50 has folded up vertically substantially out of the way. Thus as shown in FIG. 6 the upstream stapled end of the stacking set 16A is then released from the dynamic ramp system 50 to drop onto the top 42A of the stack 42. But before that that end of the set was being held up away from the stack by the dynamic ramp system 50 during the time that set 16A was being pushed out onto the stack by the set ejector finger 32, as shown in FIG. 5. Thus, as shown in FIG. 5, only the downstream end area of the set 16A was contacting and sliding over the top 42A of the stack 42. Thus, no staples 23 in the stacking set and/or the previously stacked set can engage and snag during the set stacking process (which in this embodiment involves the otherwise horizontal movement of one set relative to another). Here, the stapled side or end of the set being stacked is lifted up vertically in the compiler area before it is pushed out over the stack.

Figure 7:
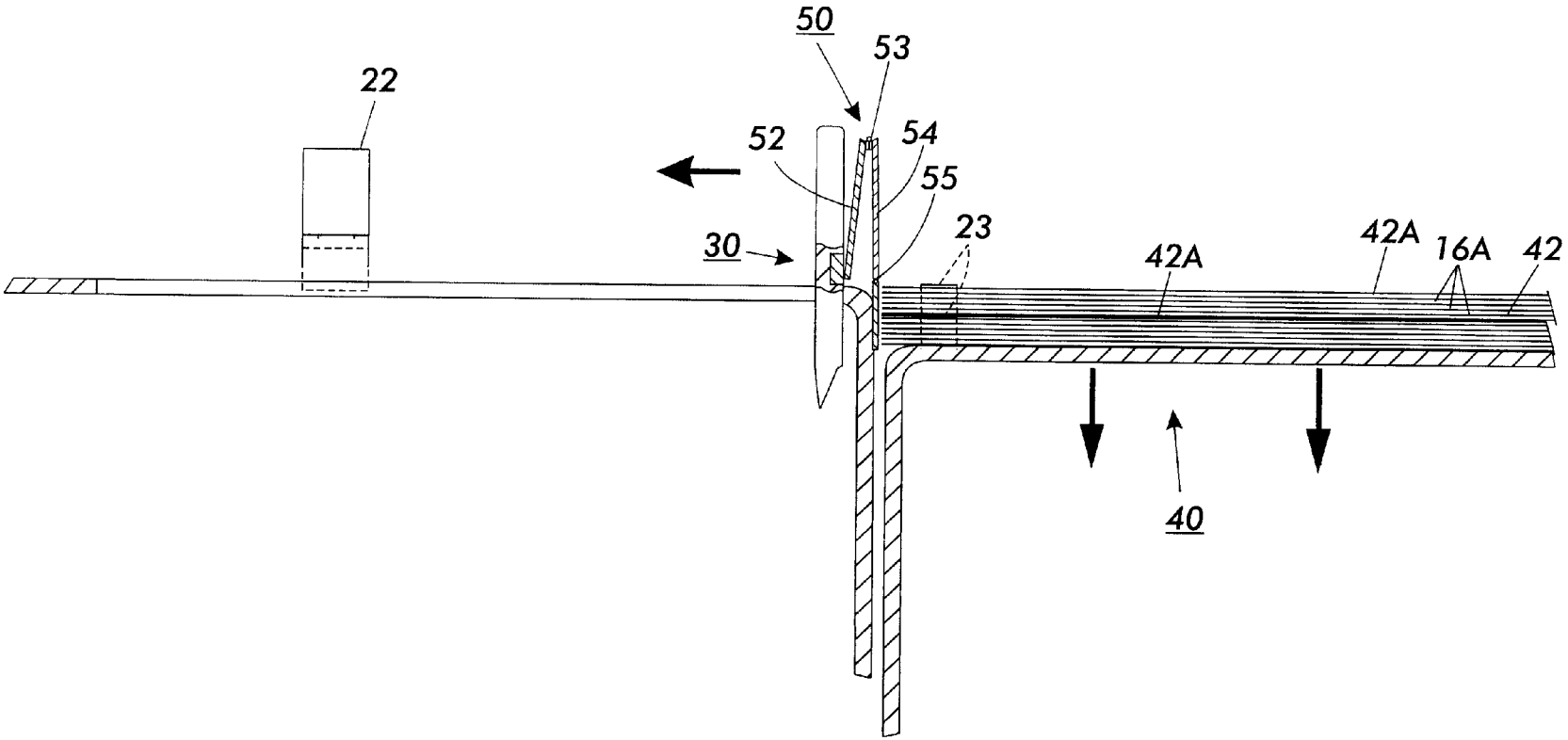
FIG. 7 is the same as FIGS. 2–6, but showing the start of the return movement of the set ejector and the consequent start of the automatic lowering of the dynamic ramp system.

Referring to FIG. 7, this shows one example of how the dynamic ramp system 50 returns to its original substantially flat position with the return or upstream movement of the set ejector system 30, after set ejection and stacking is accomplished, using a magnet 60 temporarily initially engaging the upstream end of the plate 52, assuming that has as steel or other magnetically attractible end piece. However, the re-flattening of the dynamic ramp system 50 may preferably be provided by a conventional hinge spring built into the hinge 53, or a flexible cable or other suitable connection.

As shown, and described above, the disclosed embodiment provides what may be called an automatic dynamic ramp system for a finisher-stacker that prevents or substantially reduces the opportunity for a staple or other projection of the ejecting set to snag on the previously stacked set in the output. This is accomplished in this embodiment by at least partially lifting up and holding up, during at least part of the set ejection, the stapled portion of the ejecting set before setting it down on the previously finished and stacked sets.

While staples are the illustrated, and probably most common, example of such sets fasteners or fastening means, there are other such set fasteners with similar snagging problems with these or various other set stacking systems which would also benefit from the disclosed automatic dynamic ramp system for stacking sets with the potential for snagging during stacking. For example, sets finished with set fasteners such as spiral edge binders, ring binders, tape, plastic rivets, glue, clips, etc. Also, although the illustrated dynamic ramp system 50 example is smaller than (occupying only a portion of) the illustrated sheets compiling area 20, it could alternatively be the same size or larger. It could then be permanently hinged to the set ejector. Also, the two (or more) sections thereof such as 52 and 54 could be of different sizes.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a set fastening, ejecting, and stacking system for stacking sets of multiple printed sheets onto a stack of said sets, at least some of which sets are sets of plural said printed sheets having one or more set fasteners in a fastening area of said printed sheets, wherein a said set of plural printed sheets with a said fastening area of one or more set fasteners is ejected by a set ejector with a horizontal movement component to slide out over said stack of sets of multiple printed sheets, the improvement comprising an automatic dynamic ramp system for temporarily lifting up with a vertical movement component said fastening area of said set with said set fasteners out of contact with said stack of sets of multiple printed sheets while said set is being ejected by said set ejector with said horizontal movement component to slide out over said stack of multiple printed sheets to prevent snagging of said set fasteners with said stack of sets of multiple printed sheets.

2. The set fastening, ejecting, and stacking system of claim 1, wherein said automatic dynamic ramp system for temporarily lifting up said area of said set with said set fasteners is driven by engagement with said set ejector.

3. The set fastening, ejecting, and stacking system of claim 1, wherein said automatic dynamic ramp system for temporarily lifting up said area of said set with said set fasteners comprises a foldable member that is at least partially folded up vertically by said horizontal movement component of said set ejector.

4. The set fastening, ejecting, and stacking system of claim 1, wherein said automatic dynamic ramp system for temporarily lifting up said area of said set with said set fasteners comprises a hinged plate member that is at least partially folded up vertically about said hinge by engagement with said set ejector.

5. The set fastening, ejecting, and stacking system of claim 1, wherein said automatic dynamic ramp system is automatically lowered by reverse movement of said set ejector.

6. The set fastening, ejecting, and stacking system of claim 1, wherein said set ejector has a substantially horizontal movement against said set for substantially horizontal ejection of said set onto said stack of sets, which stack of sets is at about the same level as said set being ejected.

7. The set fastening, ejecting, and stacking system of claim 1, wherein said set fasteners are staples, and comprising a set compiling and stapling area for compiling and stapling the sheets of said set, which set compiling and stapling area is partially shared with said stack of sets, and wherein said set ejector ejects said set out from said compiling and stapling area fully onto said stack of sets.

8. The set fastening, ejecting, and stacking system of claim 7, wherein said set ejector has a substantially horizontal movement against said set for substantially horizontal ejection of said set onto said stack of sets, which stack of sets is at about the same level as said set being ejected.

9. In a method of compiling and fastening together plural printed sheets into a fastened set in a compiling area, and ejecting and stacking said fastened set in an adjacent stacking area on top of a stack of other printed sheet sets, which fastened set has at least one set fastener in a fastening area, wherein said fastened set is ejected by a set ejector with a horizontal movement component over said other printed sheet sets in said stacking area, the improvement comprising automatically temporarily lifting up said fastened set in said fastening area from underneath said fastened set while said set is being ejected by said set ejector so that said fastened set slides out over said stack of other printed sheet sets in said adjacent stacking area without snagging of said set fasteners therewith.

10. The method of compiling and fastening together plural printed sheets into a fastened set in a compiling area, and ejecting and stacking said fastened set in an adjacent stacking area on top of other printed sheet sets of claim 9, wherein said automatically temporarily lifting up of said fastened set in said fastening area from underneath said fastened set while said set is being ejected is provided by a ramp member which is automatically lifted by engagement with said set ejector during said set ejection.

11. The method of compiling and fastening together plural printed sheets into a fastened set in a compiling area, and ejecting and stacking said fastened set in an adjacent stacking area on top of other printed sheet sets of claim 9, wherein said automatically temporarily lifting up of said fastened set in said fastening area from underneath said fastened set while said set is being ejected is provided by a folding ramp member which is automatically folded upwardly by engagement with said set ejector during said set ejection.

* * * * *